United States Patent [19]

Bonacci et al.

[11] 3,950,241

[45] Apr. 13, 1976

[54] METHOD FOR UPGRADING A WIDE CUT NAPHTHA TO FULL RANGE GASOLINE

[75] Inventors: John C. Bonacci, Cherry Hill; William E. Garwood, Haddonfield, both of N.J.

[73] Assignee: Mobil Oil Corporation, New York, N.Y.

[22] Filed: June 24, 1974

[21] Appl. No.: 482,537

[52] U.S. Cl. ..... 208/64; 208/60; 208/65; 208/93

[51] Int. Cl.[2] ..... C10G 37/00

[58] Field of Search ..... 208/62, 64, 65, 93, 138, 208/66

[56] References Cited

UNITED STATES PATENTS

| | | | |
|---|---|---|---|
| 3,540,996 | 11/1970 | Maziuk et al. | 208/65 |
| 3,647,679 | 3/1972 | Kirk et al. | 208/64 |
| 3,729,409 | 4/1973 | Chen | 208/138 |
| 3,759,821 | 9/1973 | Brennan et al. | 208/93 |
| 3,770,614 | 11/1973 | Graven | 208/62 |

*Primary Examiner*—Herbert Levine

*Attorney, Agent, or Firm*—Charles A. Huggett; Carl D. Farnsworth

[57] ABSTRACT

Upgrading a full boiling range naphtha by the combination of reforming only a low boiling portion of the naphtha followed by contacting the reformate product thereof combined with the high boiling portion of the naphtha over a ZSM-5 type catalyst conversion operation is described.

11 Claims, 2 Drawing Figures

FIGURE I
$C_5^+$ YIELD-OCTANE RELATIONSHIP ACROSS ZSM-5 REACTOR
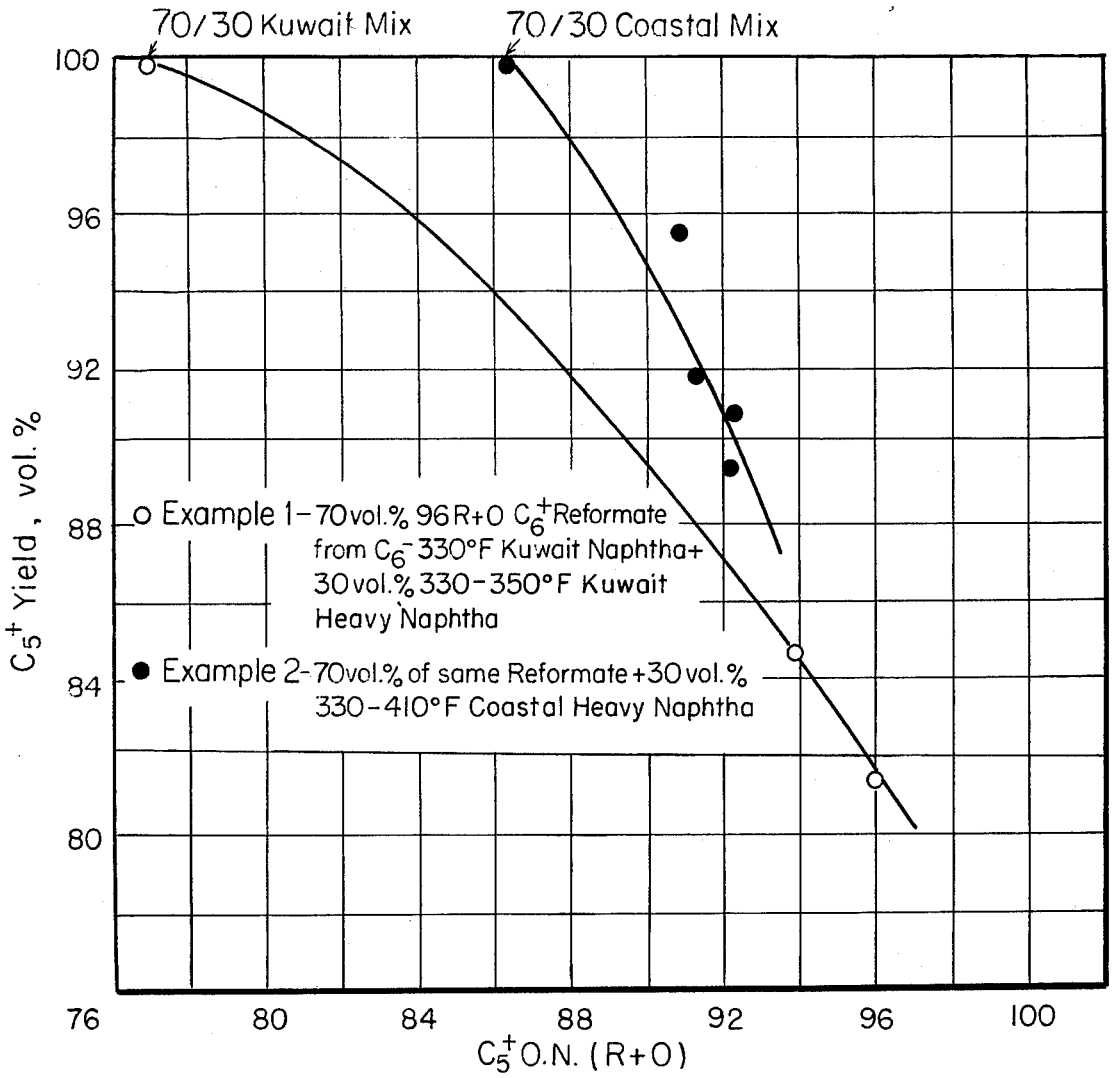
FIGURE II
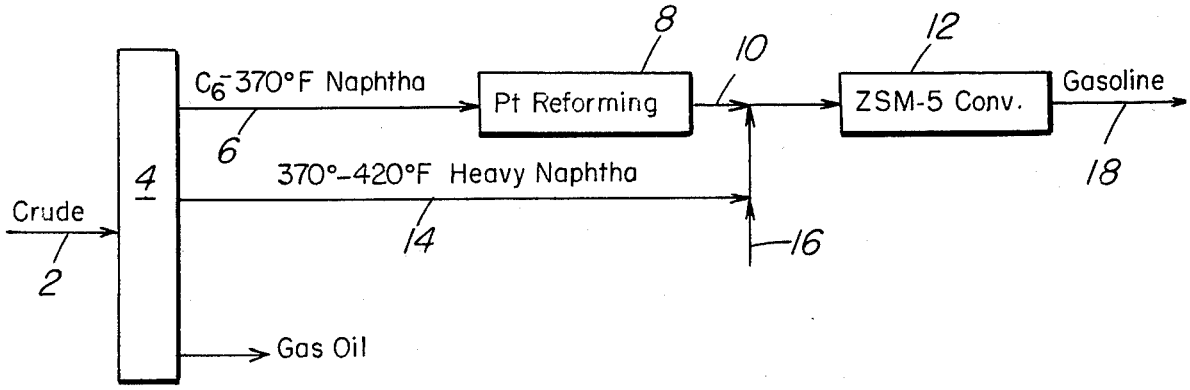

METHOD FOR UPGRADING A WIDE CUT NAPHTHA TO FULL RANGE GASOLINE

BACKGROUND OF THE INVENTION

It is generally recognized that dicyclic naphthenes found in the high boiling portion of a wide cut naphtha fraction are undesirable components for processing in a platinum reforming operation. That is, under the standard reforming operation the high boiling dicyclic naphthenes dehydrogenate to form naphthalenes which age the reforming catalyst. In addition they raise the end boiling point of the product, lower its smoke point and in general degrade the burning quality of the liquid naphtha product.

In the prior art, one way of eliminating naphthalenes is to prevent their formation from the precursor dicyclic naphthenes by cutting the end point of the charge naphtha below that of decalin, i.e., about 370°–380°F. true boiling point (T.B.P.) of trans-decalin 369°F., cis-decalin 384°F., naphthalene 424°F. However, cutting the naphtha at this low end point for the reforming operation necessarily reduces the net volume of desired reformed gasoline product.

The present invention is directed to a processing combination which increases the yield of desired octane full range gasoline product without increasing the undesired naphthalene content thereof.

SUMMARY OF THE INVENTION

The present invention is directed to a combination processing operation for upgrading a full boiling range naphtha charge to a full range gasoline product of desired octane rating. In a particular aspect the present invention is directed to reforming a naphtha charge which has been cut to substantially eliminate undesired dicyclic naphthenes, the cut point being selected within the range of 350°F. to 380°F. The naphtha charge of restricted end boiling point thus obtained is reformed under normal reforming operating conditions to produce a gasoline product of improved and desired octane rating. The octane rating will vary with the severity of the reforming operation. However, since it is desired to improve the yield of gasoline boiling product, the severity of the reforming operation is restricted to accomplish this end consistent with obtaining a desired product material. The total product of the reforming operation is then combined with the heavy end portion of the naphtha feed boiling above about 330°F. up to about 450°F. under conditions to form a mixture at a temperature in the range of 140°F. to about 450°F. This mixture is thereafter passed in contact with a ZSM-5 type crystalline zeolite under temperature conversion conditions selected from within the range of 500°F. to about 900°F.

In the combination operation of the present invention the dicyclic naphthenes pass through substantially untouched or unreacted since they do not come in contact with a reforming catalyst and are essentially unreactive at the selected ZSM-5 conversion conditions. The paraffins, on the other hand, found in the heavy naphtha portion of the charge are preferentially cracked by the ZSM-5 catalyst to more acceptable lower boiling products. In a specific embodiment it has been found that a 370° to 420°F. portion of the naphtha charge can amount to about 25 percent of a $C_6$-370°F. fraction and can be directed for use in the gasoline pool or fuel oil pool as a function of seasonal demands.

An important but not limiting aspect of the combination operation of this invention is that a cool heavy naphtha charge can be used to cool the reformate or reformer effluent to a temperature suitable for processing over the ZSM-5 catalyst. Also the reforming operation may be reduced to a two reactor system in which the third reactor is then relied upon for housing the ZSM-5 conversion catalyst. The ZSM-5 crystalline zeolite catalyst may be used with or without a metal hydrogenating component such as nickel, zinc, palladium, etc.

BRIEF DESCRIPTION OF THE DRAWINGS

FIG. I is a graph identifying the improved full boiling gasoline products obtained by the processing combination of the present invention and compared with a prior art method of operation.

FIG. II is a diagrammatic representation of the processing combination of the present invention involving reforming and ZSM-5 selective conversion.

DISCUSSION OF SPECIFIC EMBODIMENTS

The following examples were developed with some typical refinery stocks to demonstrate the improvement obtained by the concept of the present invention.

The catalyst employed in the examples was a high silica to alumina (140/1) Ni/HZSM-5 crystalline zeolite catalyst which had been sulfided.

EXAMPLE 1

A $C_6$-330°F. Kuwait naphtha was first reformed over a platinum reforming catalyst to a 96 O.N. (R+O) product. This product was blended with a 330°–350°F. straight run naphtha fraction in the ratio of 70/30 volume percent. The octane number (O.N.) of this blend was 77 R+O and this was raised to 96 O.N. ($C_5$+ material) at 11 LHSV by processing over the above identified Ni/HZSM-5 catalyst at a temperature of about 800°F., a pressure of 350 psig, and a 7–7.5/1 H/HC (hydrogen to hydrocarbon) mole ratio. Essentially no decalins were present in the "heavy" naphtha portion of the charge because of its low cut point. The yield-octane curve of this example is shown on FIG. I.

EXAMPLE 2

In this example a heavy naphtha fraction was added to the reformate product of Example 1. The heavy naphtha fraction amounted to 30 vol.% of 330 to 410°F., Coastal naphtha containing 35% of 2 ring naphthenes. Because of its low paraffin content, the O.N. (R+O) of the blend was only reduced to 86. Converting this blend by contact with the ZSM-5 catalyst of Example 1 at 28 to 7 LHSV increased the blend to 91–92 ($C_5$+) O.N. at a higher yield than obtained in Example 1. The yield-octane curve for this example is presented on FIG. I for comparison with that obtained by Example 1. It was also found that the most significant change in composition is to lower the paraffin concentration obtained as by a shape selective cracking of low octane normal and singly branched paraffins. The 1 and 2 ring naphthenes remained essentially unchanged and the naphthalene content remained at 0.2–0.3 weight percent. Therefore the end point remained about the same as shown by the table below.

| ASTM Dist. °F. | Charge Blend 86 O.N.(R+O) | Product 91 O.N.(R+O) |
|---|---|---|
| IBP | 166 | 130 |
| 5% | 190 | 177 |
| 10 | 200 | 195 |
| 20 | 218 | 218 |
| 30 | 236 | 237 |
| 40 | 259 | 262 |
| 50 | 282 | 284 |
| 60 | 302 | 304 |
| 70 | 322 | 321 |
| 80 | 339 | 341 |
| 90 | 361 | 362 |
| 95 | 380 | 382 |
| EP | 402 | 409 |

EXAMPLE 3

A 330°F.–410°F. Coastal heavy naphtha alone was processed over the ZSM-5 catalyst at 7 LHSV, thereby raising the O.N. of this material from 63 to 70 ($C_5$+ material) with essentially no change in the naphthalene content thereof (0.3–0.4 wt.%). Blending this 70 octane product with the 96 O.N. reformate product of Example 1 provides a blended octane value of only 88. This O.N. is considerably lower than that obtained by processing combination of Example 2, thus indicating it is necessary to run the process as in Example 2 in order to obtain the results desired.

The processing combination of this invention is applicable to substantially a naphtha stream whether straight run materials or products of cracking such as catalytic and hydrocracking products containing dicyclic naphthenes. Thus the lighter portion of the straight run naphtha may be blended after reforming thereof with a heavy naphtha product of hydrocracking alone or in combination with the heavy straight run naphtha material which is then converted with the ZSM-5 catalyst.

Referring now to FIG. I, there is shown a plot of the data obtained particularly by Examples 1 and 2 above discussed. The figure is self-explanatory. It clearly shows the improved octane-yield relationship obtained by the processing sequence of Example 2 over that obtained by Example 1.

Referring now to FIG. II. there is shown diagrammatically the processing concept of the present invention. In the arrangement of the figure, a crude oil is charged by conduit 2 to a distillation column 4 wherein separation is made in a manner known in the prior art. In the arrangement of this invention the straight run naphtha separated from the crude charge is recovered as a light naphtha fraction boiling in the range of $C_6$ to about 370°F. and a heavier naphtha fraction boiling generally in the range of 370°F. to 420°F. Under some circumstances it may be preferred to employ a lower cut point such as 330°F. or 360°F. The light naphtha fraction is passed from the distillation zone 4 by conduit 6 to a platinum reforming operation 8 wherein the light naphtha is subjected to a reforming operation consistent with producing a desired octane product in large yields. Therefore the reforming operation particularly contemplated is a relatively mild reforming operation producing reformate of an octane rating in the range of 92 to 96 R+O. The total reformer effluent or only the normally liquid reformate product is then passed by conduit 10 to a ZSM-5 catalyst conversion zone 12. The heavy naphtha fraction separated in zone 4 is passed by conduit 14 to conduit 10 wherein it is mixed with the product of reforming to form a mix within the temperature boiling range of 140°F. to about 420°F. Additional heavy naphtha such as a product of hydrocracking may be introduced by conduit 16 to the process. The blend of heavy naphtha to the normally liquid product of reforming is generally restricted to within the range of 10 to 30 volume percent, it being preferred to restrict it to within the range of 15 to 25 volume percent. During this blending or mixing step essentially in conduit 10, cooling of the effluent obtained from the reforming operation may be accomplished.

In conversion zone 12, the blend of naphtha materials is subjected to conversion conditions including a temperature within the range of 500° to 900°F. at a pressure within the range of 200 to 600 psig. The ZSM-5 conversion operation may be a fixed or fluid catalyst bed operation. Also as mentioned above, the ZSM-5 conversion operation may be accomplished in the third reactor of the reforming operation since only a two reactor reforming step will generally be needed to accomplish the relatively mild reforming operation desired. The gasoline product of the combination operation is withdrawn by conduit 18 as product of the process.

Having thus generally described the combination operation of the present invention and discussed specific examples going to the very essence thereof, it is to be understood that no undue restrictions are to be imposed by reason thereof.

We claim:

1. A method for improving the octane rating of a full boiling range naphtha to gasoline produce which comprises, separating a full range naphtha to recover a low boiling naphtha fraction thereof substantially free of dicyclic naphthenes from a higher boiling naphtha fraction containing said dicyclic naphthenes, reforming said low boiling fraction under conditions of severity selected to increase the octane rating of gasoline boiling range product, combining the product of the reforming operation with said higher boiling naphtha fraction containing dicyclic naphthenes and passing the combined materials comprising product of reforming and said higher boiling naphtha fraction in contact with a ZSM-5 type crystalline zeolite catalyst under exothermic temperature conditions within the range of 500° to 900°F.

2. The method of claim 1 wherein the high boiling naphtha fraction is relied upon to cool the product of reforming to a temperature suitable for contact with the crystalline zeolite catalyst.

3. The method of claim 1 wherein reforming of the low boiling naphtha fraction is accomplished in not more than two separate beds of reforming catalyst before contact with said crystalline zeolite catalyst.

4. The method of claim 1 wherein the combined material catalyst is promoted with a metal hydrogenating component.

5. The method of claim 1 wherein the reforming of the low boiling naphtha fraction is accomplished under conditions providing a reformate product of an octane rating in the range of 92 to 96 (R+O).

6. The method of claim 1 wherein the total product of reforming is combined with said higher boiling naphtha fraction.

7. The method of claim 1 wherein only the normally liquid portion of the product of reforming is combined with the higher boiling naphtha fraction.

8. The method of claim 1 wherein a heavy naphtha product of hydrocracking is combined with combined material passed in contact with said crystalline zeolite catalyst.

9. The method of claim 1 wherein a blend of heavy naphtha with the normally liquid product of reforming is restricted to within the range of 10 to 30 volume percent.

10. The method of claim 1 wherein the blend of heavy naphtha and the product of reforming is subjected to a ZSM-5 zeolite catalyst conversion conditions including a temperature within the range of 500° to 900°F. at a pressure within the range of 200 to 600 psig.

11. The method of claim 1 wherein the crystalline zeolite conversion is accomplished in a fluid catalyst bed operation.

* * * * *

UNITED STATES PATENT AND TRADEMARK OFFICE

CERTIFICATE OF CORRECTION

PATENT NO. : 3,950,241

DATED : April 13, 1976

INVENTOR(S) : JOHN C. BONACCI and WILLIAM E. GARWOOD

It is certified that error appears in the above-identified patent and that said Letters Patent are hereby corrected as shown below:

Column 4, lines 59-60 "combined material" should be --crystalline zeolite--.

Signed and Sealed this

*twenty-ninth* Day of *June 1976*

[SEAL]

*Attest:*

RUTH C. MASON
*Attesting Officer*

C. MARSHALL DANN
*Commissioner of Patents and Trademarks*